United States Patent [19]

Takigawa et al.

[11] Patent Number: 4,685,544

[45] Date of Patent: Aug. 11, 1987

[54] SLIDING EXHAUST GAS BRAKE

[75] Inventors: Kazunori Takigawa, Numazu; Ryoichi Suzuki, Mishima, both of Japan

[73] Assignee: Usui Kokusai Sangyo Kabushiki Kaisha, Sunto, Japan

[21] Appl. No.: 844,987

[22] Filed: Mar. 27, 1986

[51] Int. Cl.[4] ..... F02D 9/06

[52] U.S. Cl. ..... 188/273; 123/323; 188/154

[58] Field of Search ..... 123/323; 188/154, 273

[56] References Cited

U.S. PATENT DOCUMENTS 4,553,648 11/1985 Suzuki et al. ..... 188/154 X

*Primary Examiner*—Duane A. Reger

*Attorney, Agent, or Firm*—Anthony J. Casella; Gerald E. Hespos

[57] ABSTRACT

A sliding exhaust gas brake connected in the exhaust pipe of an engine in a motor vehicle. It includes a housing having a portion defining an exhaust gas passage and connected to the exhaust pipe at both ends thereof and a portion connected to the exhaust gas passage substantially at right angles thereto and defining a chamber in which a valve member is slidably disposed. A valve actuator has one end connected to a housing wall defining the end of the chamber. The actuator includes a piston and a piston rod extending into the housing through the housing wall and having one end on which the valve member is supported. A partition is provided in the housing for dividing the chamber into a first portion in which the valve member is slidably disposed and a second portion into which the piston rod extends. The partition has an opening aligned with the exhaust gas passage. The opening has an edge defining a valve seat on which the valve member rests when closing the exhaust gas passage. The valve member is slidable on the partition and is received into the first portion of the chamber when opening the passage. The first portion of the chamber is fluidally connected with the exhaust gas passage upstream of the partition.

4 Claims, 2 Drawing Figures

PRIOR ART

SLIDING EXHAUST GAS BRAKE

BACKGROUND OF THE INVENTION

1. Field of the Invention

This invention relates to a sliding exhaust gas brake which is connected in the exhaust pipe of an engine in a large motor vehicle, such as a truck or bus, for stopping the flow of exhaust gas to impose an increased load on the engine and thereby exert a braking action on the vehicle especially when it goes down a steep slope.

2. Description of the Prior Art

There is known a sliding exhaust gas brake which is typically constructed as shown in FIG. 2. It comprises a housing 11 in which a slidable valve member 13 is disposed. The housing 11 has a portion defining an exhaust gas passage 12 and connected to an exhaust pipe at both ends 11' and 11'' thereof and a portion connected to the exhaust gas passage 12 substantially at right angles thereto and defining a valve chamber 14 in which the valve member 13 is reciprocally movable. The valve chamber 14 has an open end through which the valve member 13 is movable into, or out of, the exhaust gas passage 12. The opposite end of the valve chamber 14 is closed by a wall to which a valve actuator 15 is connected. The actuator 15 comprises a cylinder joined to the end wall of the valve chamber 14, a piston in the cylinder and a piston rod 16 connected to the piston at one end and extending into the housing 11 through the end wall of the valve chamber 14. The valve member 13 is supported on the other end of the piston rod 16. The housing 11 has a valve seat 17 surrounding the exhaust gas passage 12, and on which the valve member 13 rests when closing the passage 12. The valve member 13 has a gas pressure control hole 18 which can be closed by an auxiliary valve member 13'. A sealing member 19 and a bearing 19' are provided in the wall between the valve chamber 14 and the actuator 15 and the piston rod 16 extends through the sealing member 19 and the bearing 19'. A couple of arrows in FIG. 2 show the direction in which exhaust gas flows through the exhaust gas passage 12.

When the valve member 13 is moved to a closing position by the introduction of high pressure gas into the one cylinder chamber remote from the housing 11 or the draw by vacuum suction from the other cylinder chamber, however, exhaust gas having an elevated pressure pushes the valve member 13 and thereby forms a clearance C between the upstream portion of the valve member 13 and the adjacent wall portion of the housing 11. The clearance C establishes communication between the exhaust gas passage 12 upstream of the valve member 13 and the valve chamber 14 and allows the exhaust gas to flow into the valve chamber 14. The exhaust gas contains fine carbon particles and has a high temperature. Those carbon particles and the heat of the exhaust accelerate the aging and wear of the sealing member 19 and the bearing 19'. If they are worn, exhaust gas flows into the actuator 15 and shortens its life. Moreover, the flow of exhaust gas into the actuator 15 gives rise to a delay in the movement of the valve member 13. As a result, the brake fails to function satisfactorily quickly.

SUMMARY OF THE INVENTION

It is an object of this invention to provide an improved sliding exhaust gas brake which is free from any of the problems as hereinabove pointed out, and which works smoothly and quickly and has a long life.

This object is attained by a brake which is essentially characterized by including a partition provided in a housing for separating a valve chamber from a housing portion into which a piston rod extends. When an exhaust gas passage is closed by a valve member, it rests on a valve seat defined by a housing wall portion and an edge portion of the partition and allows exhaust gas to flow into the valve chamber, while the partition allows no exhaust gas to flow into the housing portion into which the piston rod extends. There is no fear of too early aging or wear of any sealing member or bearing by the fine carbon particles which exhaust gas contains, or its heat. There is no fear of exhaust gas flowing into a valve actuator and disabling it to move the valve member smoothly.

DETAILED DESCRIPTION OF THE INVENTION

Figure 1:
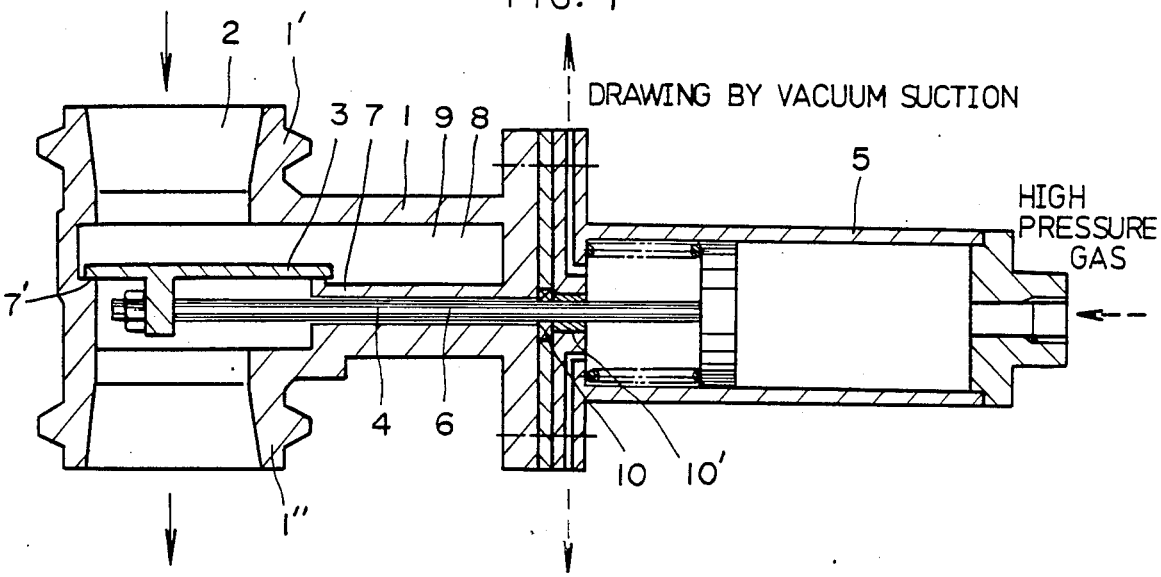
FIG. 1 is a longitudinal sectional view of a sliding exhaust gas brake embodying this invention.

Referring to FIG. 1 of the drawing, a sliding exhaust gas brake embodying this invention includes a housing 1 having a portion defining an exhaust gas passage 2 and connected to an exhaust pipe at both ends 1' and 1'' thereof. The housing 1 also has a portion connected to the exhaust gas passage 2 substantially at right angles thereto and defining a valve chamber 4 in which a valve member 3 is slidably disposed. The brake also includes a valve actuator 5 connected to the end wall of the valve chamber 4. It is essentially identical in construction to the actuator hereinbefore described with reference to FIG. 2. It includes a piston rod 6 extending into the housing 1 and supporting the valve member 3 at its free end. A device for supplying high pressure gas is connected to the end of the actuator 5 remote from the housing 1, or a drawing device by vacuum suction to the opposite end thereof, for moving a piston to reciprocate the piston rod 6 so that the valve member 3 may be moved to close or open the exhaust gas passage 2.

According to a salient feature of this invention, the housing 1 includes a partition 7 dividing the valve chamber 4 into a portion upstream of the valve member 3 and a portion downstream thereof. The partition 7 extends from the end wall of the housing 1 and preferably forms an integral part thereof. The upstream portion defines a gas collecting chamber 8 into which exhaust gas is received when the passage 2 is closed by the valve member 3. The downstream portion defines the housing portion into which the piston rod 6 extends. The partition 7 has an opening aligned with the exhaust gas passage 2 and having an edge defining a valve seat 7' on which the valve member 3 can rest when closing the passage 2. The valve member 3 is slidable on the partition 7. The gas collecting chamber 8 serves as a chamber 9 into which the valve member 3 is received when opening the passage 2. A sealing member 10 and a bearing 10' are provided in the wall through which the piston rod 6 extends into the housing 1.

Figure 2:
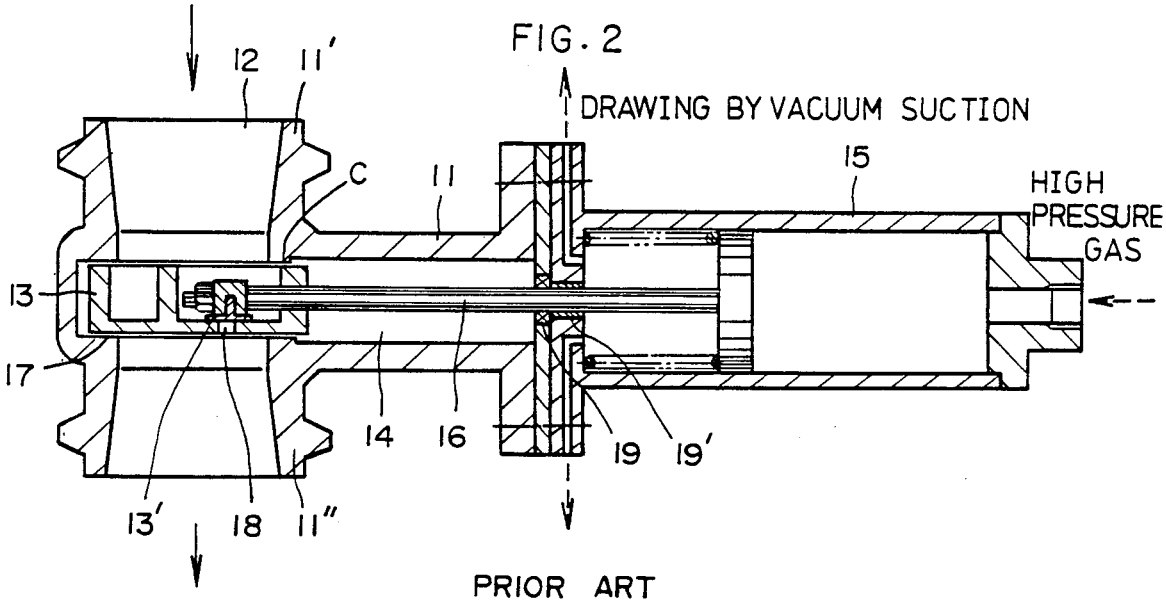
FIG. 2 is a longitudinal sectional view of a known sliding exhaust gas brake.

While the valve member 3 has been shown as comprising a simple plate, it is, of course, possible to employ a valve member of the type shown in FIG. 2 having a gas pressure control hole and an auxiliary valve member by which the hole can be closed.

When the passage 2 is closed by the valve member 3 as shown in FIG. 1, exhaust gas flows into the chamber 8 and its elevated pressure urges the valve member 3 against the valve seat 7'. Therefore, the valve member 3 and the partition 7 form a complete seal against the flow of exhaust gas into the area into which the piston rod 6 extends.

What is claimed is:

1. In a sliding exhaust gas brake comprising a housing having a portion defining an exhaust gas passage having opposed upstream and downstream ends and connected to an exhaust pipe in a motor vehicle at both said ends thereof and a portion connected to said passage substantially at right angles thereto and defining a chamber in which a valve member is slidably disposed, and a valve actuator having one end connected to a housing wall defining the end of said chamber, said actuator including a piston and a piston rod extending into said housing through said housing wall and having one end on which said valve member is supported, the improvement which comprises a partition provided in said housing for dividing said chamber into an upstream portion in which said valve member is slidably disposed and a downstream portion into which said piston rod extends, said partition having an opening aligned with said passage, said opening having an edge defining a valve seat on which said valve member rests when closing said passage, said valve member being slidable on said partition and received into said upstream portion when opening said passage, said upstream portion being fluidally connected with said passage upstream of said opening.

2. A brake as set forth in claim 1, wherein said partition forms an integral part of said housing.

3. A brake as set forth in claim 1, wherein a source of high pressure gas supply is connected to the opposite end of said actuator remote from said one end thereof.

4. A brake as set forth in claim 1, wherein a drawing device by vacuum suction is connected to said one end of said actuator.

* * * * *